US011185160B2

(12) United States Patent
Uffmann

(10) Patent No.: US 11,185,160 B2
(45) Date of Patent: Nov. 30, 2021

(54) CORNER-CABINET ARRANGEMENT

(71) Applicant: Ninkaplast GmbH, Bad Salzuflen (DE)

(72) Inventor: Axel Uffmann, Melle (DE)

(73) Assignee: Ninkaplast GmbH, Bad Salzuflen (DE)

( * ) Notice: Subject to any disclaimer, the term of this patent is extended or adjusted under 35 U.S.C. 154(b) by 0 days.

(21) Appl. No.: 16/954,400

(22) PCT Filed: Jan. 11, 2019

(86) PCT No.: PCT/EP2019/050652
§ 371 (c)(1),
(2) Date: Jun. 16, 2020

(87) PCT Pub. No.: WO2019/141599
PCT Pub. Date: Jul. 25, 2019

(65) Prior Publication Data

US 2021/0085076 A1 Mar. 25, 2021

(30) Foreign Application Priority Data

Jan. 19, 2018 (DE) ..... 202018100309.7

(51) Int. Cl.
*A47B 49/00* (2006.01)
*A47B 96/02* (2006.01)

(52) U.S. Cl.
CPC ..... *A47B 49/006* (2013.01); *A47B 96/02* (2013.01)

(58) Field of Classification Search
CPC ..... A47B 49/006; A47B 96/02
USPC ..... 312/238
See application file for complete search history.

(56) References Cited

U.S. PATENT DOCUMENTS 2,239,734 A 4/1941 Pratt
3,198,594 A * 8/1965 Murray ..... A47B 49/006 312/238
3,257,154 A * 6/1966 Lewis ..... A47B 49/00 312/198
4,146,280 A 3/1979 Crownhart
4,348,069 A * 9/1982 Lindsay ..... E06B 3/482 312/324
4,832,300 A 5/1989 Twellmann
5,662,398 A * 9/1997 Swallow ..... A47B 81/002 312/238

(Continued)

FOREIGN PATENT DOCUMENTS

CN 2872969 Y 2/2007
DE 1249476 11/1968

(Continued)

*Primary Examiner* — James O Hansen
(74) *Attorney, Agent, or Firm* — Richard M. Goldberg

(57) ABSTRACT

A corner-cabinet arrangement having two corpus areas which are rectangular in plan view and each of which has a front with a door, the fronts running together at right angles in an inside corner such that the two corpus areas enclose between them a corner space that is rectangular in plan view, the arrangement including a shelf which extends in a first one of the corpus areas and in a part of the corner space and, when the door is open, can be pivoted out of the door opening of the corpus-area, the second corpus area also having a shelf that extends in this corpus area and in another part of the corner space, and, when the door is open, can be pivoted out of the door opening of the corpus area, wherein pivotal axes of the two shelves are different from one another.

10 Claims, 9 Drawing Sheets

(56) References Cited

U.S. PATENT DOCUMENTS 7,559,614 B2 * 7/2009 Zheng ..... A47B 43/00
312/238

FOREIGN PATENT DOCUMENTS

| | | | |
|---|---|---|---|
| DE | 8624899 | U1 | 12/1986 |
| DE | 9415344 | U1 | 12/1994 |
| DE | 20117891 | U1 | 3/2002 |
| DE | 202005018868 | U1 | 3/2006 |
| DE | 102005049392 | A1 | 4/2007 |
| DE | 202006017567 | U1 | 4/2008 |
| DE | 202011000471 | U1 | 7/2012 |
| EP | 0722679 | A2 | 7/1996 |
| EP | 1616503 | A2 | 1/2006 |
| EP | 2253244 | B1 | 1/2014 |
| EP | 3403528 | A1 | 11/2018 |
| GB | 803676 | | 10/1958 |
| JP | 2-26506 | | 1/1990 |

* cited by examiner

CORNER-CABINET ARRANGEMENT

BACKGROUND OF THE INVENTION

The invention relates to a corner-cabinet arrangement having two corpus areas which are rectangular in plan view and each of which has a front with a door, the fronts running together at right angles in an inside corner such that the two corpus areas enclose between them a corner space that is rectangular in plan view, the arrangement comprising a shelf which extends in a first one of the corpus areas and in a part of the corner space and, when the door is open, can be pivoted out of the door opening of the corpus-area.

Such corner-cabinet arrangements are commonly used, in particular as kitchen floor cabinets.

Typically, the corpuses of kitchens floor cabinets have a rectangular footprint, so that, when the two fronts of two of such corpuses form an inside corner, a corner space is formed between the side walls of these corpuses, the corner space being rectangular in plan view or, if the corpuses have the same depth, being square in plan view. Frequently, this corner space is simply covered by a countertop which is L-shaped in plan view, and the corner space remains unused.

However, corner-cabinet arrangements have become known in which two corpuses, which are rectangular in plan view are arranged such that one of them occupies not only the first corpus area but also the corner space, whereas the other corpus occupies only the second corpus area. Then, the corner space forms part of the interior space of the first corpus but is difficult to access through the comparatively narrow door opening of this corpus. In order facilitate access to the corner space, it has been known to mount shelves, which cover most of the surface area of the first corpus area and of the corner space, in such a way that they can be moved out through the door opening in a pivotal movement or a combined translational and pivotal movement and may then be drawn out further, as the case may be, so that the part of the shelf that was originally accommodated in the corner space can now be accessed more easily. DE 86 24 899 U1. DE 20 2006 017 567 U1, EP 1 616 503 A2 and EP 2 253 244 B1 describe examples of mounting structures that allow for such a movement of the shelf in a corner-cabinet corpus.

For kinematic reasons, however, the shelf may not occupy the entire surface area of the first corpus area and the corner space. As a general rule, the necessary movement pattern for the shelf becomes increasingly complicated when the internal space of the corpus is utilized by the shelf more efficiently.

In another corner solution, which has been described for example in DE 20 2011 000 471 U1, the shelf forms a carrousel that is rotatable about a vertical axis, and the door is arranged in an inside corner of the cabinet and is held on the carrousel.

SUMMARY OF THE INVENTION

It is an object of the invention to provide a corner-cabinet arrangement which permits a more efficient use of the corner space even in case of simple kinematics of the shelves.

According to the invention, in order to achieve this object, the second corpus area also has a shelf that extends in the corpus area and in another part of the corner space, and, when the door is open, can be pivoted out of the door opening of the corpus area.

Thus, according to the invention, the corner space is utilized by two shelves, each of which extends into another one of the two corpus areas. Both shelves together can then form a storage space which largely exhausts the footprint of the corner space wherein, however, each individual shelf covers only a part of this corner space. This makes it possible to select the dimensions and the shape of each shelf such that, in order to provide easy access to the entire storage space, it can be moved relatively far out of the door opening with a relatively simple movement pattern.

Useful details of the invention are indicated in the dependent claims.

In one embodiment, the corner-cabinet arrangement is constituted by two separate corpuses each of which occupies one of the two rectangular corpus areas as well as a part of the corner space. The borderline between the two parts of the corner space that belong to different corpuses may for example extend along a diagonal of this corner space, so that each of the two corpuses, as a whole, is trapezoidal in plan view. The two corpuses may have the same depth, so that the corner space has a square cross-section. The two corpuses may have an identical width or may have different widths, so that the corner-cabinet arrangement is either symmetric or asymmetric with respect to the diagonal of the corner space.

The doors of the two corpuses may be hinged on the inside, so that their hinges are mounted on the two vertical edges of the door openings that are adjacent to one another in the inside corner. Optionally, however, they may also be hinged on the outside, so that the hinges are located on the sides of the door openings that are remote from the inside corner. An asymmetric hinge pattern wherein one door is hinged on the inside and the other door is hinged on the outside is also possible.

Finally, it is also possible to conceive of solutions wherein at least one of the two doors is configured as a sliding door. In a particularly useful embodiment, the sliding door is guided on the corpus such that, in the open position, it extends along the diagonal of the corner space. This has the advantage that the door opening can be cleared without the necessity to provide space outside of the respective corpus for accommodating the sliding door in its open position.

The cabinet corpus having the trapezoidal footprint is usable not only for corner solutions but permits also a design of kitchen furniture, or furniture in general, wherein the walls of the cabinet corpuses do not all form right angles with one another but comprise also walls that are inclined relative to the front plane. Also in case of these corpuses, the shelves are configured to be pivoted-out to permit an efficient space usage. Thus, in another aspect, the invention also provides a cabinet with the features indicated in the claims.

BRIEF DESCRIPTION OF THE DRAWINGS

Embodiment examples will now be described in conjunction with the drawings, wherein.

DETAILED DESCRIPTION

Figure 1:
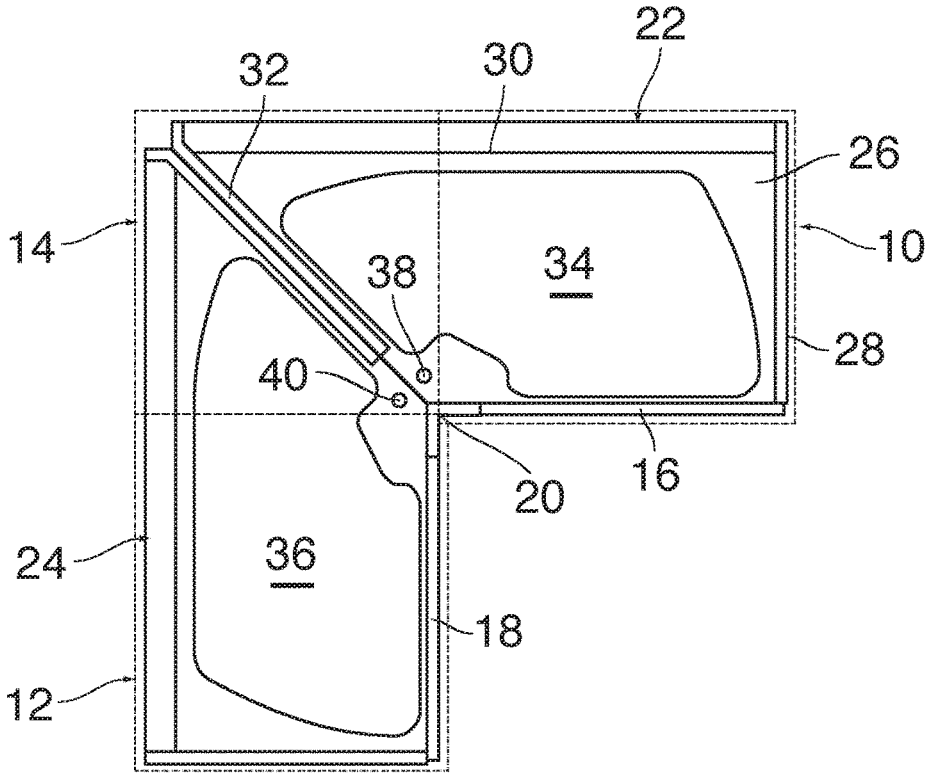
FIG. 1 shows a corner-cabinet arrangement according to a first embodiment example of the invention in plan view.

FIG. 1 shows, in a schematic plan view, a corner-cabinet arrangement, e.g. an arrangement of floor cabinets in a built-in kitchen. The arrangement comprises three areas that are rectangular in plan view, namely a first corpus area 10, a second corpus area 12 and a corner space 14. Each of the two corpus areas 10, 12 have a front that is essentially constituted by a door 16 and 18, respectively. The two fronts run together in an inside corner 20.

In the example shown, the corpus areas 10, 12 have an identical depth, so that the corner space 14 enclosed between them is square in plan view.

In the example shown, the arrangement is formed by two separate corpuses 22, 24 that are mirror-symmetric to one another and are each trapezoidal in plan view and each comprise one of the two corpus areas 10, 12 as well as one half of the corner space 14, so that they abut against one another in the corner space along a diagonal of this corner space. In this example, each corpus has a floor 26, a side wall 28, a rear wall 30 and an inclined wall 32 that extends along the diagonal of the corner space 14. The inclined wall 32 does not have to be completely closed and may optionally be omitted in its entirety because it only separates the interior of the one corpus 22 from the interior of the other corpus 24.

In each of the two corpuses 22, 24, there is provided a shelf 34, 36 that occupies the largest part of the surface area of the first corpus area 10 and the second corpus area 12, respectively, and extends also into the corner space 14, so that it occupies also the half of this corner space that is associated with the respective corpus 22 or 24.

Figure 2:
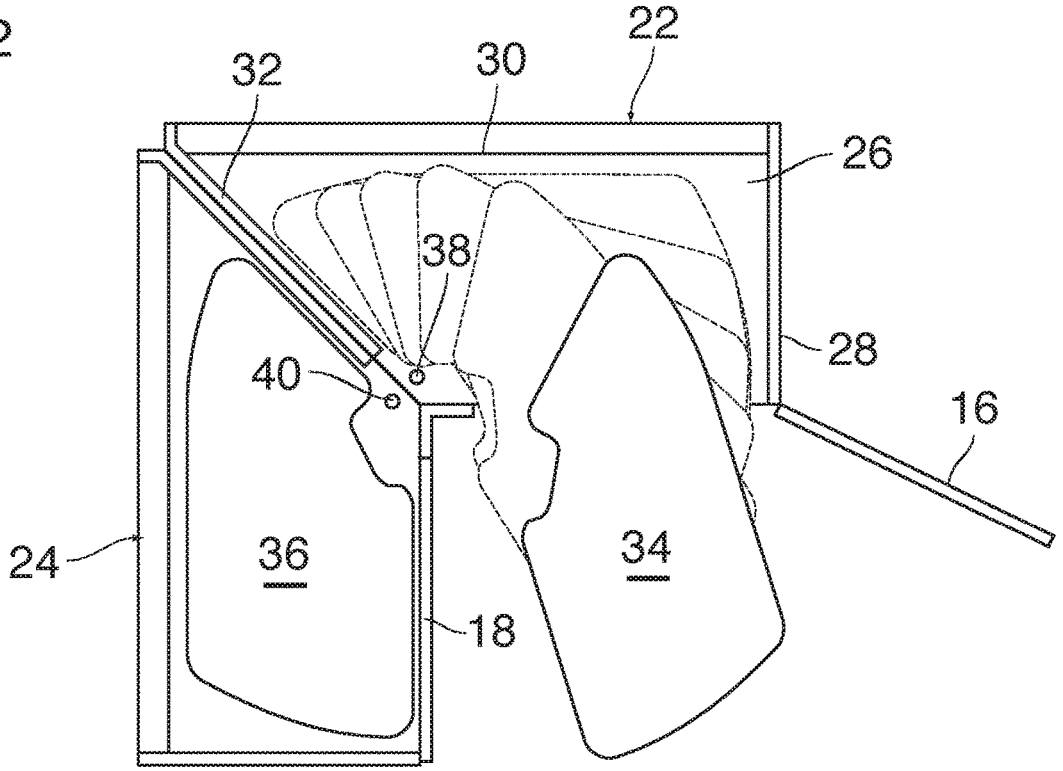
FIG. 2 shows the arrangement according to FIG. 1 in a condition in which one door is open and a shelf has been drawn-out.

By means of a mounting structure that is known as such and will therefore not be described in detail here, each shelf 34, 36 is pivotable about a pivotal axis 38 and 40, respectively, so that, when the door 16 is open, it may be moved out of the door opening in a pivotal movement to which a translational movement may be superposed, as has been shown for the shelf 34 in FIG. 2. The contours of the shelves 34, 36 are rounded such that the shelf can be pivoted-out through the door opening without colliding with the side wall 28 or the rear wall 30 of the respective corpus.

In FIG. 2, the shelf 34 has been shown in continuous lines in an end position in which it is not only pivoted about the axis 38 but has also been drawn-out linearly from the door opening, so that the entire storage space of the shelf is easily accessible for a user.

In an analogous way, the shelf 36 may also be pivoted-out through the door opening 24 that is closed by the door 18 in FIG. 2.

Each of the two corpuses 22, 24 may optionally have a plurality of shelves that may be arranged to be pivoted and drawn-out individually or jointly. The shelves in the different corpuses 22, 24 do not necessarily have to be arranged at the same level.

Figure 3:
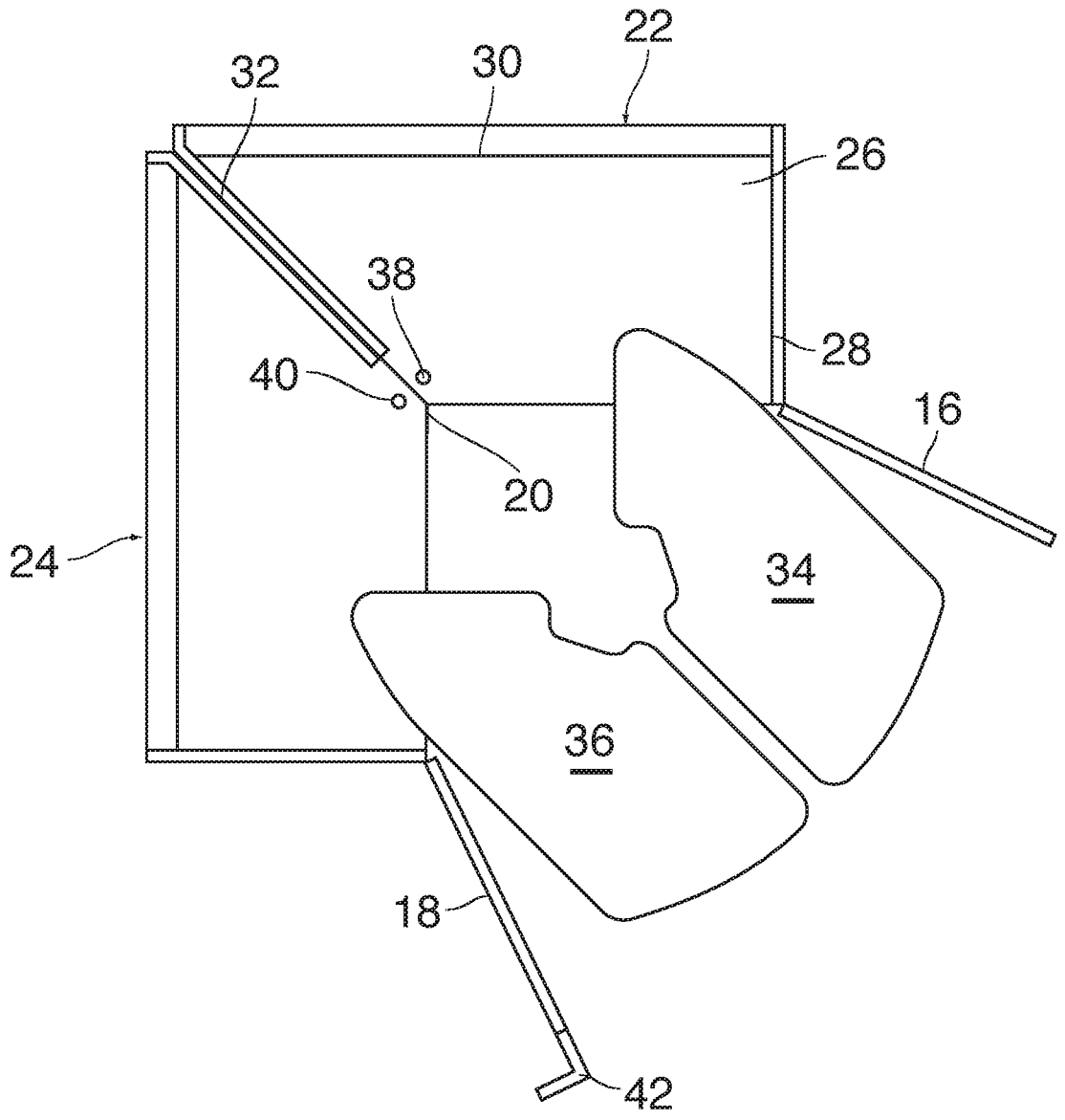
FIG. 3 shows the arrangement according to FIG. 1 in a condition in which two doors are open and two shelves have been drawn-out.

FIG. 3 shows the corner-cabinet arrangement in a condition in which both doors 16, 18 are open and both shelves 34, 36 have been pivoted and drawn-out. The door 18 of the corpus 24 is different from the door 16 of the corpus 22 in that a vertically extending angular profile 42 is provided on the free end of the door 18, the profile having a free leg that is flush with the door 16 when the door 18 is closed (FIG. 1).

Figure 4:
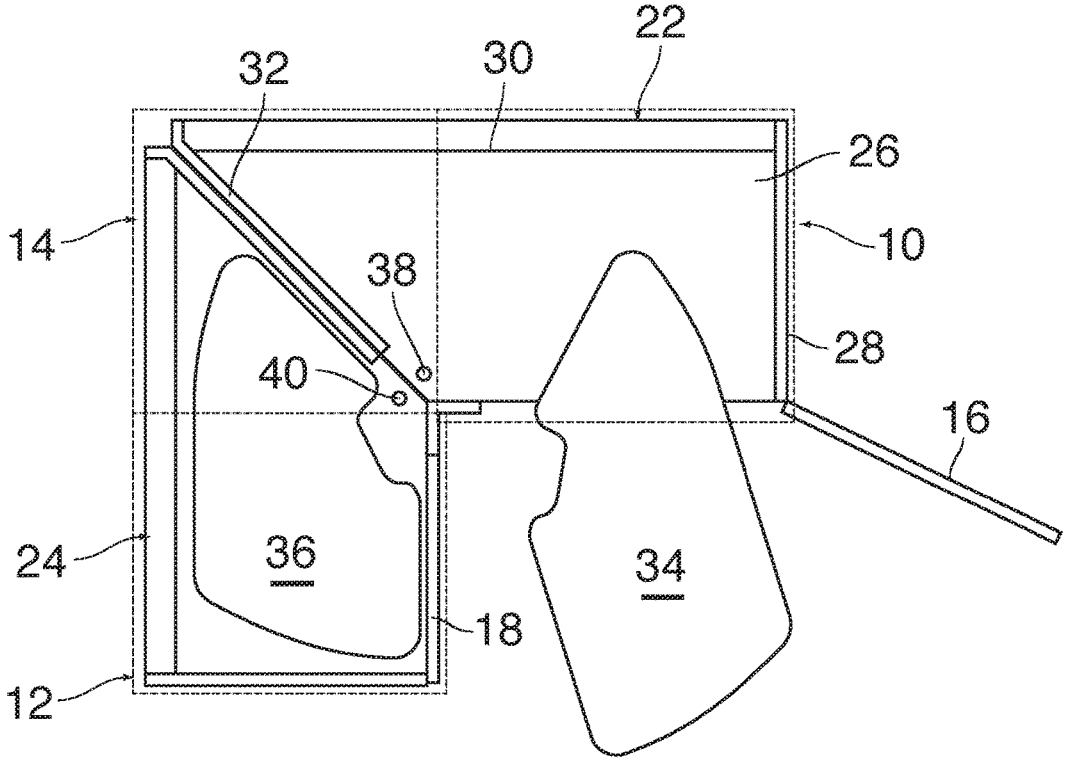
FIG. 4 shows an example of an asymmetric corner-cabinet arrangement.

FIG. 4 shows a modified embodiment in which the two corpus areas 10, 12 have an identical depth but different widths, so that the arrangement as a whole is asymmetric with respect to the diagonal of the corner space 14. Consequently, the two corpuses 22, 24 together form an L-shaped footprint with legs of different lengths.

Figure 5:
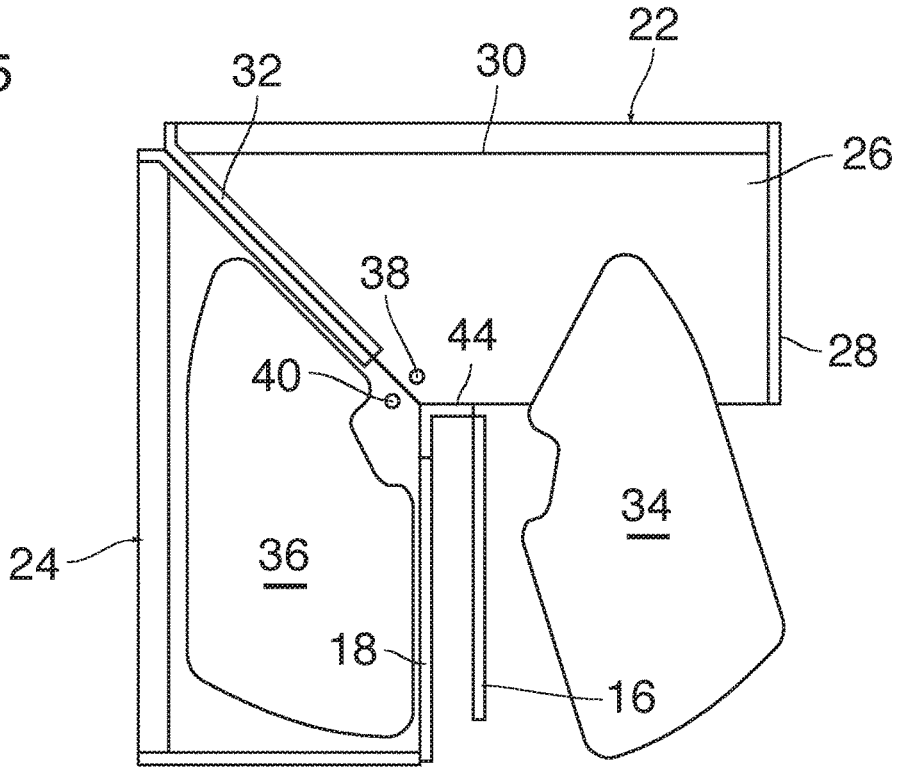
FIG. 5 shows an example of an arrangement with doors hinged on the inside.

In the embodiments shown in FIGS. 1 to 4, the doors 16, 18 are respectively hinged on the outside, i.e. they are connected to the side wall 28 of the respective corpus by hinges that have not been shown. FIG. 5 shows an alternative in which the doors 16, 18 are hinged on the inside, i.e. at the vertical edges of the door openings that are disposed adjacent to each other in the vicinity of the inside corner. In this case, the door 18 does not have an angular profile, but instead there is provided a ledge 44 which has the same shape as the angular profile 42 in FIG. 3 but is fixed with respect to the corpuses 22, 24. Both doors 16, 18 are connected to the ledge 44 by hinges that have not been shown. In the condition shown in FIG. 5, the door 16 is open and the shelf 34 has been drawn out. Analogously, the door 18 may be opened in order for the shelf 36 to be drawn out. Of course, this modified embodiment is also possible in case of an asymmetric configuration of the corpuses 22, 24.

Figure 6:
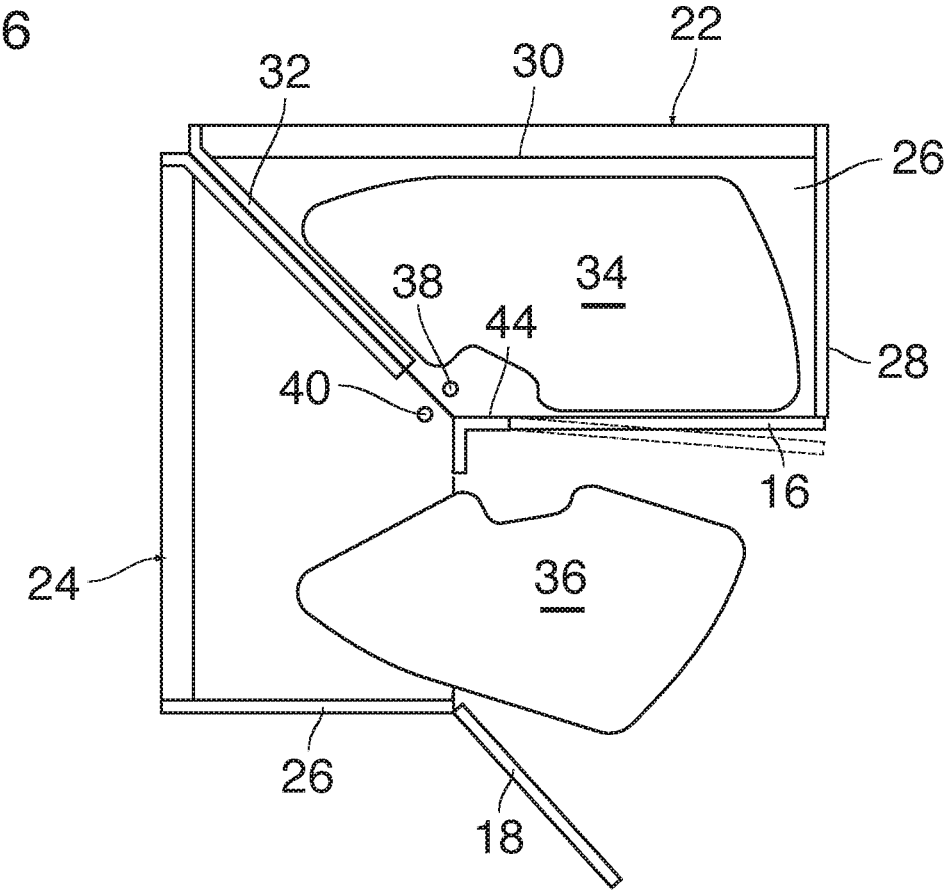
FIG. 6 shows an arrangement with one door hinged on the inside and another door hinged on the outside.

FIG. 6 shows a modification in which the door 16 of the corpus 22 is hinged on the inside, i.e. on the ledge 44, whereas the door 18 of the corpus 24 is hinged on the outside, i.e. on the side wall 28 of this corpus. The corpuses 22, 24 have an asymmetric configuration in this example, but the same hinge pattern is of course possible also in case of a symmetric configuration.

Figure 7:
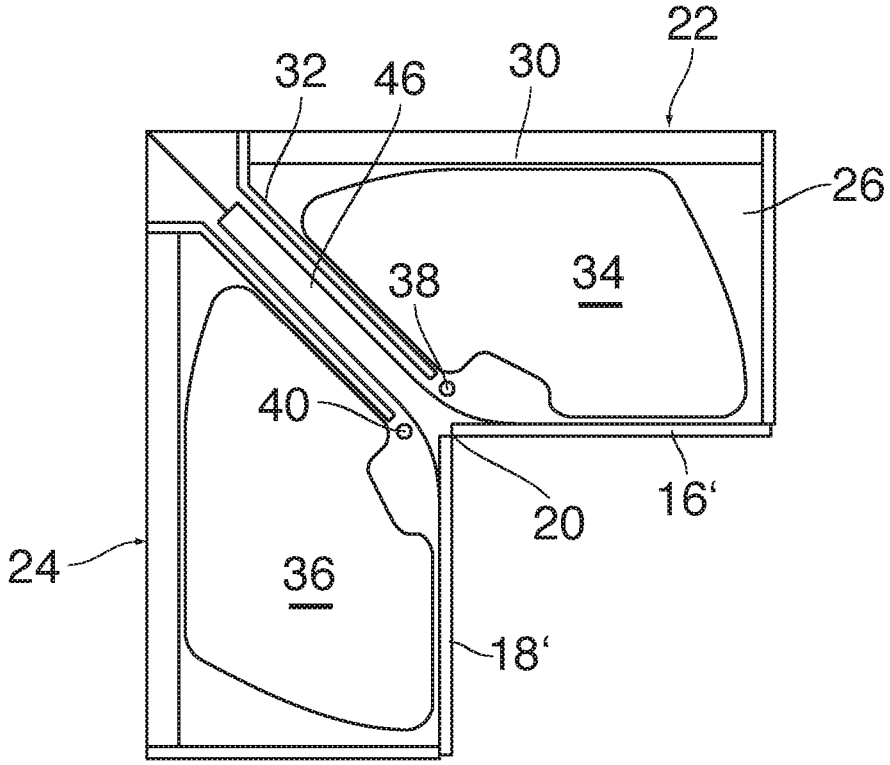
FIG. 7 shows an arrangement with two sliding doors.
Figure 8:
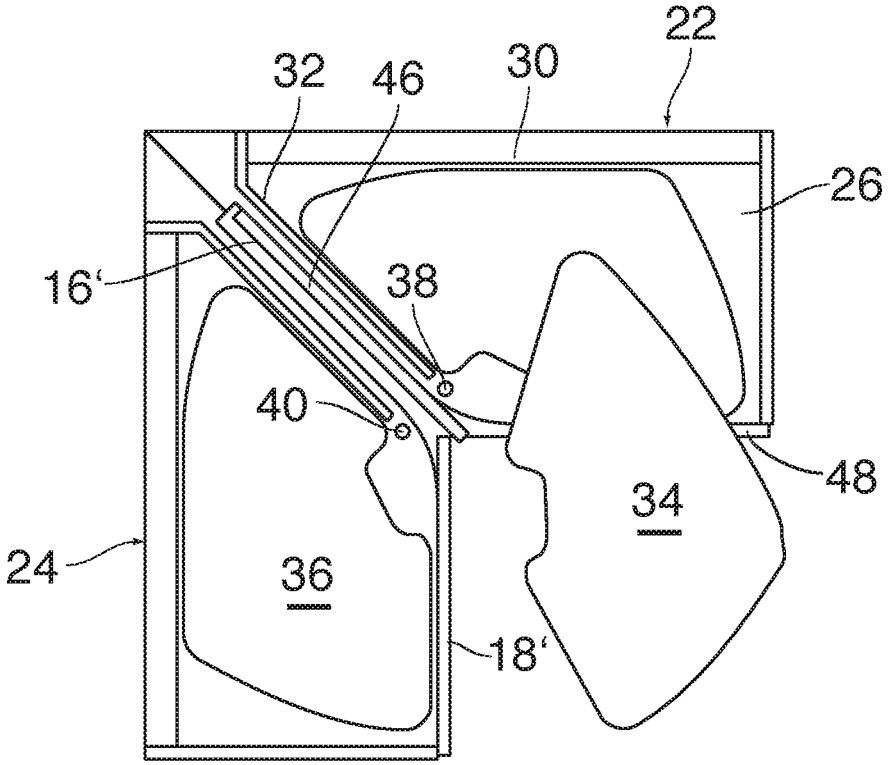
FIGS. 8 and 9 show the arrangement according to FIG. 7 in different open/closed conditions.
Figure 9:
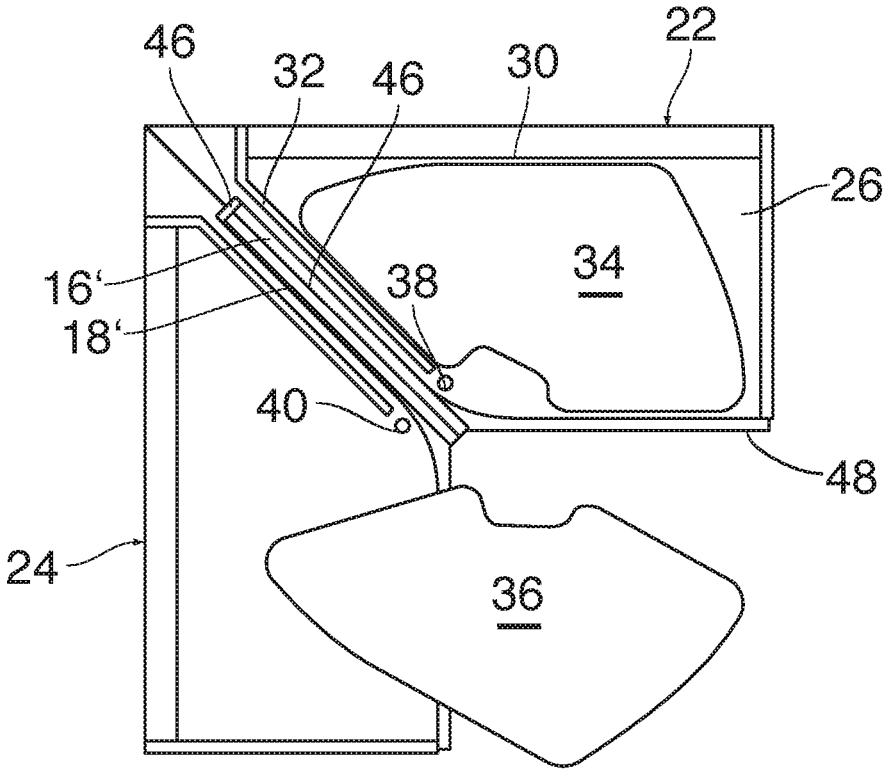

FIGS. 7 to 9 illustrate an embodiment in which the pivotable doors 16, 18 have been replaced by sliding doors 16', 18'. The inclined walls 32 of the two corpuses 22, 24 are in this case spaced apart from one another, so that they form a duct 46 that can accommodate each of the two doors 16, 18 as well as both doors together in their open position, as has been shown in FIGS. 8 and 9. The duct 46 is widened towards the inside corner 20, so that the sliding doors 16', 18' that are guided along the floors 26 and possibly the top walls of the corpuses by suitable fittings can be introduced into the duct 46 in a combined pivotal and sliding movement in order to clear the door openings.

In FIG. 8, the sliding door 18' is closed whereas the sliding door 16' is open and has been slid into the duct 46, so that the shelf 34 may be drawn out through the door opening that has been cleared in this way. A guide track 48 for the lower edge of the sliding door is visible at the lower edge of the door opening.

In FIG. 9, both sliding doors 16', 18' are open and accommodated in the duct 46. The shelf 36 has been shown in the drawn-out position.

Figure 10:
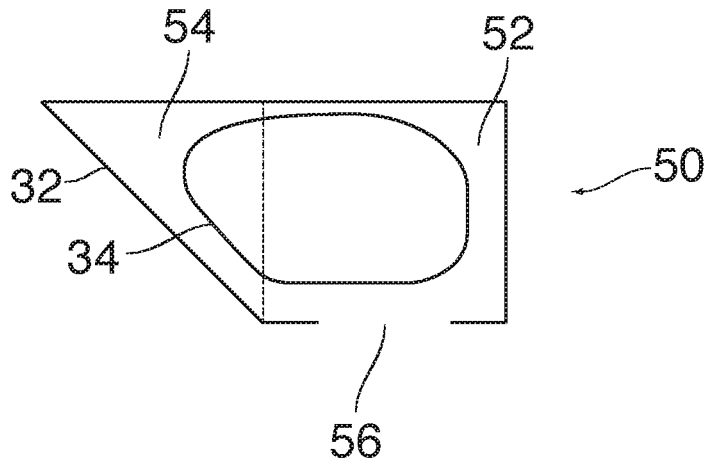
FIG. 10 shows a single cabinet which is trapezoidal in plan view.

FIG. 10 shows, in a schematic plan view, a cabinet with a trapezoidal corpus 50. The trapezoidal footprint is composed of a rectangular corpus area 52 and a triangular corpus area 54. In its general design, the cabinet shown in FIG. 10 corresponds to the corpus 22 of the corner-cabinet arrangement shown in FIG. 1. FIG. 10 shows also the footprint of the shelf 34 that can be pivoted-out through a door opening 56, and the position of the inclined wall 32 has also been shown, which inclined wall does not necessarily have to abut against another corner-cabinet element. The door opening 56 is formed in the shorter base side of the trapezoidal footprint, and the shelf 34 has been shown in its position in which it is fully accommodated in the cabinet and extends also into the triangular corpus area 54.

Figure 11:
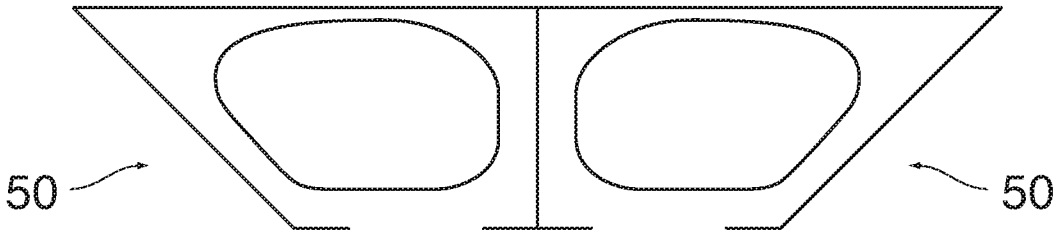
FIGS. 11 to 16 show examples of cabinet arrangements with cabinets of the type shown in FIG. 10.

FIG. 11 shows a cabinet arrangement with two corpuses 50 of the type shown in FIG. 10 which are arranged mirror-symmetrically with respect to one another, so that the inclined walls 32 are visible from the interior of a room.

Figure 12:
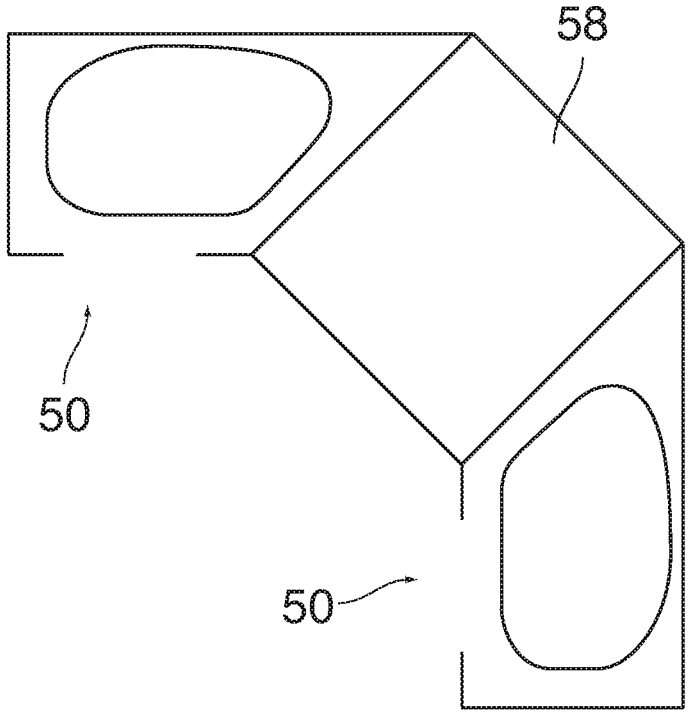
Figure 13:
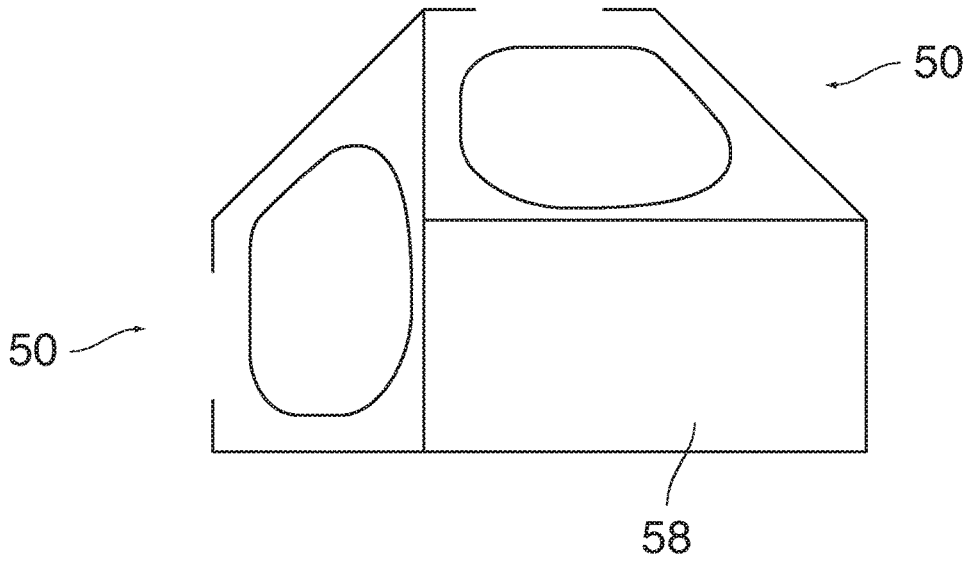
Figure 14:
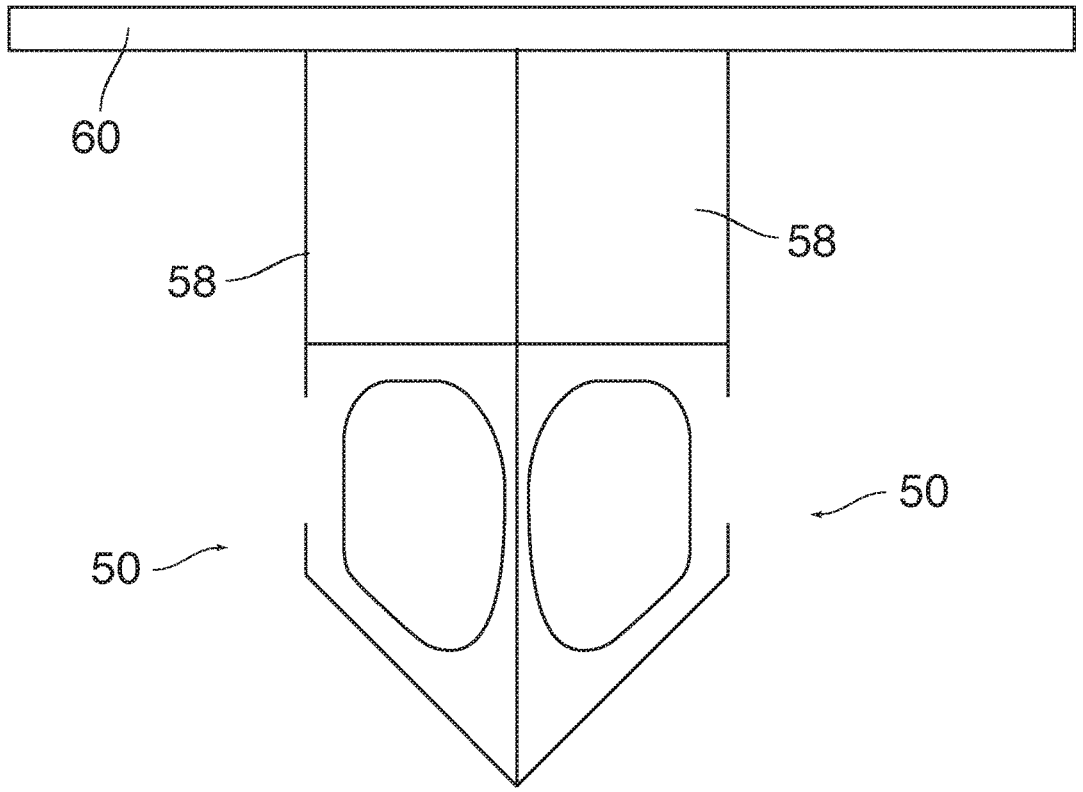

FIG. 12 shows another arrangement with a combination of two trapezoidal cabinets and another cabinet with a rectangular footprint. This arrangement may for example be installed as a stand-alone island in a kitchen.

Further examples of possible arrangements of the trapezoidal cabinets in combination with conventional cabinets with rectangular footprint have been shown in FIGS. 13 to 16. The arrangement shown in FIG. 13 may for example be utilized as an island solution, whereas the arrangement shown in FIG. 14 may, optionally, also be installed adjacent to a wall 60 such that the trapezoidal cabinets project into the room whereas rectangular cabinet elements 58 have a respective side wall abutting at the wall 60.

Figure 15:
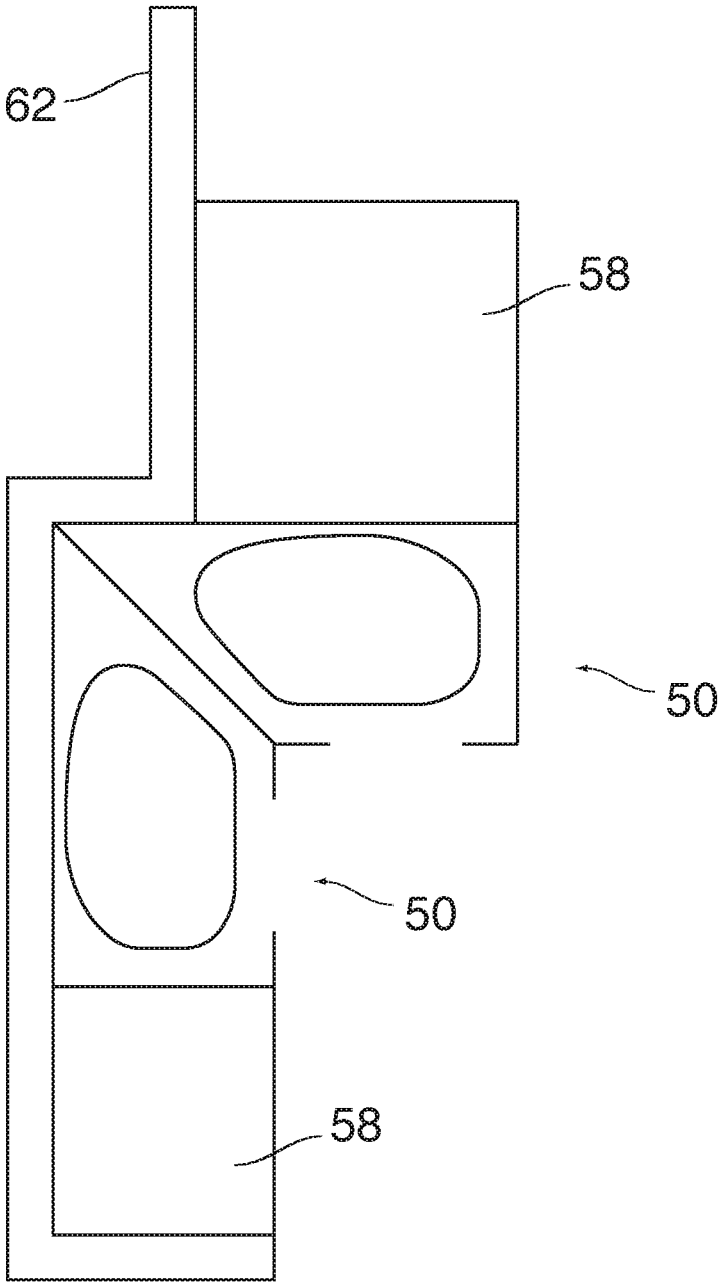

FIG. 15 illustrates a possibility to fill a recces, formed in a wall 62, with cabinets.

Figure 16:
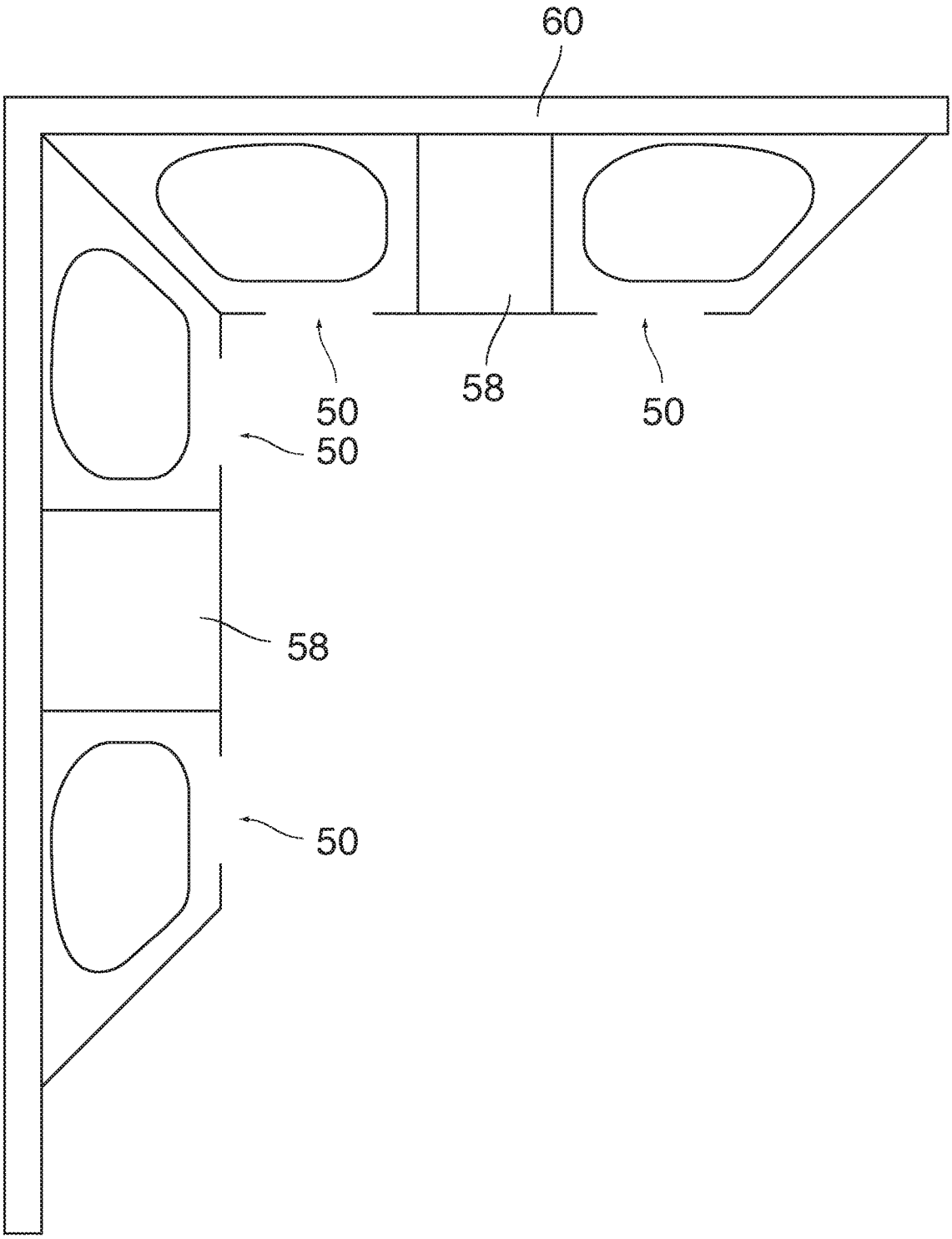

FIG. 16 illustrates a corner solution with four trapezoidal cabinet elements.

What is claimed is:

1. A corner-cabinet arrangement comprising:

first and second corpus areas which are rectangular in plan view and each of which has a front with a door which closes a respective door opening, the fronts running together at right angles in an inside corner such that the first and second corpus areas enclose between them a corner space that is rectangular in plan view, a first shelf which extends in the first corpus area and in a part of the corner space and, when the door of the first corpus area is open, is adapted to be pivoted out of the door opening of only the first corpus area about an axis that is fixed relative to the first corpus area, the door of the first corpus having a first door pivot and the first shelf having a first shelf pivot which is different from the first door pivot, a second shelf which extends in the second corpus area and in another part of the corner space, and, when the door of the second corpus area is open, is adapted to be pivoted out of the door opening of only the second corpus area about an axis that is fixed relative to the second corpus area, the door of the second corpus having a second door pivot and the second shelf having a second shelf pivot which is different from the second door pivot, and pivotal axes of the two shelves being different from one another.

2. The arrangement according to claim 1, wherein the shelves extend in parts of the corner space that are separated from one another by a diagonal of this corner space.

3. The arrangement according to claim 1, wherein the corner space is square in plan view.

4. The arrangement according to claim 3, comprising two separate corpuses which are each trapezoidal in plan view and each of which forms one of the corpus areas as well as a part of the corner space.

5. The arrangement according to claim 4, wherein footprints of the corpuses are symmetric to one another with respect to a diagonal of the corner space.

6. The arrangement according to claim 1, wherein at least one of the doors is a pivoting door hinged on a side of an inside corner.

7. The arrangement according to claim 1, wherein the shelves are respectively arranged to be pivoted and pulled-out through the respective door opening in a superposed pivotal and translational movement.

8. A corner-cabinet arrangement comprising:

first and second corpus areas which are rectangular in plan view and each of which has a front with a door which closes a respective door opening, the fronts running together at right angles in an inside corner such that the first and second corpus areas enclose between them a corner space that is rectangular in plan view, a first shelf which extends in the first corpus area and in a part of the corner space and, when the door of the first corpus area is open, is adapted to be pivoted out of the door opening of only the first corpus area about an axis that is fixed relative to the first corpus area, a second shelf which extends in the second corpus area and in another part of the corner space, and, when the door of the second corpus area is open, is adapted to be pivoted out of the door opening of only the second corpus area about an axis that is fixed relative to the second corpus area, pivotal axes of the two shelves being different from one another, wherein at least one of the doors is a pivoting door that is hinged on a side of the door opening opposite to an inside corner.

9. A corner-cabinet arrangement comprising:

first and second corpus areas which are rectangular in plan view and each of which has a front with a door which closes a respective door opening, the fronts running together at right angles in an inside corner such that the first and second corpus areas enclose between them a corner space that is rectangular in plan view, a first shelf which extends in the first corpus area and in a part of the corner space and, when the door of the first corpus area is open, is adapted to be pivoted out of the door opening of only the first corpus area about an axis that is fixed relative to the first corpus area, a second shelf which extends in the second corpus area and in another part of the corner space, and, when the door of the second corpus area is open, is adapted to be pivoted out of the door opening of only the second corpus area about an axis that is fixed relative to the second corpus area, pivotal axes of the two shelves being different from one another, wherein at least one of the doors is a sliding door.

10. The arrangement according to claim 9, further comprising a duct that accommodates the at least one sliding door in an open position thereof and which is formed along a diagonal of the corner space.

* * * * *